United States Patent [19]

Noguchi et al.

[11] Patent Number: 4,919,101

[45] Date of Patent: Apr. 24, 1990

[54] FUEL SUPPLY CONTROL SYSTEM FOR INTERNAL COMBUSTION ENGINES

[75] Inventors: Kunio Noguchi; Masayuki Ueno; Kazushige Toshimits, all of Wako, Japan

[73] Assignee: Honda Giken Kogyo Kabushiki Kaisha, Tokyo, Japan

[21] Appl. No.: 241,927

[22] Filed: Sep. 8, 1988

[30] Foreign Application Priority Data

Sep. 8, 1987 [JP] Japan ..... 62-224814

[51] Int. Cl.[5] ..... F02D 41/12

[52] U.S. Cl. ..... 123/493

[58] Field of Search ..... 123/325, 327, 492, 493

[56] References Cited

U.S. PATENT DOCUMENTS 4,459,962 7/1984 Yamato et al. ..... 123/493

4,690,117 9/1987 Isobe et al. ..... 123/493 X

*Primary Examiner*—Tony M. Argenbright

*Attorney, Agent, or Firm*—Lyon & Lyon

[57] ABSTRACT

A fuel supply control system for an internal combustion engine comprises deceleration detecting device for detecting a predetermined decelerating condition of the engine, and fuel supply decreasing device for decreasing the supply of fuel to the engine when the predetermined decelerating condition is detected by the deceleration detecting device. A first counting device starts to count a first predetermined time period when the high-load detecting device detects that the engine has left the predetermined high-load condition. An inhibiting device inhibits the fuel supply decreasing device from operating when the deceleration detecting device detects the predetermined decelerating condition of the engine before the first counting device completes counting the first predetermined time period. A second counting device counts a second predetermined time period while the high-load detecting device is detecting the predetermined high-load condition of the engine. The first counting device starts to count the first predetermined time period when the second counting device has completed counting the second predetermined time period. An intake air increasing device increases the amount of intake air supplied to the engine while the inhibiting device is operating.

13 Claims, 8 Drawing Sheets

| |
|---|
| FIG. 2A |
| FIG. 2B |

FUEL SUPPLY CONTROL SYSTEM FOR INTERNAL COMBUSTION ENGINES

BACKGROUND OF THE INVENTION

The present invention relates to fuel supply control systems for use in internal combustion engines, and more particularly to a system for properly controlling the air-fuel ratio of a mixture of fuel supplied to an internal combustion engine when the engine has shifted from a high-load operation to a low-load operation.

Conventionally, a fuel supply control method for internal combustion engines is known, e.g., from Japanese Patent Application No. 61-294283, which method is applied to a fuel injection device which has a single fuel injection valve arranged in a united portion of an intake pipe at a location upstream of a throttle valve, for injecting fuel into a plurality of cylinders of the engine to thereby reduce the number of valves and hence lower the manufacturing cost of the fuel injection device.

On the other hand, an air-fuel ratio control method is also known, which controls the air-fuel ratio of a mixture supplied to the engine depending upon operating conditions of the engine so as to improve the fuel consumption and emission characteristics, etc., of the engine. According to this known method, as shown in FIG. 9, as the engine is decelerated to shift from a high-load operating condition to a low-load operating condition, the air-fuel ratio is controlled in such a manner that open-loop control is effected for enriching the mixture in the high-load operating region, i.e., a wide-open-throttle region, feedback control is effected in a medium-load operating region, i.e., a feedback control region, to bring the air-fuel ratio to a stoichiometric value, and open-loop control is effected for leaning the mixture in the low-load operating region, i.e., a mixture leaning region, in the mentioned order. Further, the fuel supply to the engine is interrupted in a predetermined decelerating region, i.e., a fuel cut region, shown by the area lower than the dotted line in FIG. 9, which is included within the mixture leaning region.

However, the method has the disadvantage that if the above sequential control is effected when the engine shifts from the wide-open-throttle region to the mixture leaning region within a brief time after staying in the wide-open-throttle region for a long time, since mixture-enriching control has been effected for a long time in the wide-open-throttle region, a large amount of fuel adheres to the inner wall of the intake pipe, throttle valve, etc. at the departure of the engine from the wide-open-throttle region, but only little of the adhering fuel is drawn into combustion chambers while the engine is passing the feedback control region, because the engine stays in the feedback control region for a short period of time. Thus, most of the fuel remains within the intake pipe even when the engine has then left the feedback control region. After the engine has shifted to the mixture leaning region, the adhering fuel is drawn in large quantities into the combustion chambers due to a decrease in absolute pressure within the intake pipe, whereas, in the mixture leaning region, the throttle valve is fully closed or slightly opened and hence the intake air introduced into the intake pipe is small in amount. Consequently, a very overrich mixture is supplied into the combustion chambers. As a result, part of the mixture will not be burnt within the combustion chambers, and the unburnt fuel is emitted from the combustion chambers into the engine exhaust system, thereby causing so-called after-fire within the exhaust system. Particularly, if the engine is provided with a three-way catalyst as an exhaust-gas purifying device in the exhaust system, such after-fire causes an excessive rise in the temperature of the three-way catalyst, thereby deteriorating the performance of same and hence shortening the service life thereof.

Particularly, in an internal combustion engine of the aforementioned type having a fuel injection valve arranged upstream of the throttle valve, the intake pipe has a long span between the injecting location of the injection valve and the combustion chambers so that the amount of fuel adhering to the intake pipe etc. becomes considerably large, thus making the above problem more serious.

SUMMARY OF THE INVENTION

It is the object of the invention to provide a fuel supply control system for internal combustion engines, which is capable of reducing the amount of unburnt fuel emitted from the engine when the engine shifts from a high-load operating condition to a decelerating operating condition, thereby preventing the occurrence of after-fire and the resulting deterioration of the three-way catalyst.

To attain the above object, the present invention provides a fuel supply control system for an internal combustion engine having a plurality of cylinders, and an intake pipe connected to the cylinders and having a diversified portion and a united portion, the fuel supply control system including at least one fuel injection valve arranged in the united portion of the intake pipe, for supplying fuel to the cylinders, deceleration detecting means for detecting a predetermined decelerating condition of the engine, and fuel supply decreasing means for decreasing the supply of fuel to the engine through the fuel injection valve when the predetermined decelerating condition is detected by the deceleration detecting means.

The system according to the invention is characterized by an improvement comprising:

(1) high-load detecting means for detecting whether the engine is in a predetermined high-load condition or not;

(2) first counting means associated with the high-load detecting means, for starting to count a first predetermined time period when the high-load detecting means detects that the engine has left the predetermined high-load condition; and (3) inhibiting means associated with the first counting means and the deceleration detecting means, for inhibiting the fuel supply decreasing means from operating when the deceleration detecting means detects the predetermined decelerating condition of the engine before the first counting means completes counting the first predetermined time period.

Preferably, the predetermined decelerating condition may comprise a mixture leaning condition, and a fuel-cut condition, the fuel supply decreasing means being operable insofar as the inhibiting means is inoperative to decrease the amount of fuel supplied to the engine when the engine is in the mixture leaning condition, and to interrupt the supply of fuel to the engine when the engine is in the fuel-cut condition.

Also preferably, the fuel supply control system may include second counting means associated with the high-load detecting means, for counting a second predetermined time period while the high-load detecting means is detecting the predetermined high-load condition of the engine, the first counting means being associated with the second counting means, for starting to count the first predetermined time period when the second counting means has completed counting the second predetermined time period.

Preferably, the fuel supply control means may include intake air increasing means associated with said inhibiting means, for increasing the amount of intake air supplied to said engine while said inhibiting means is operating.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
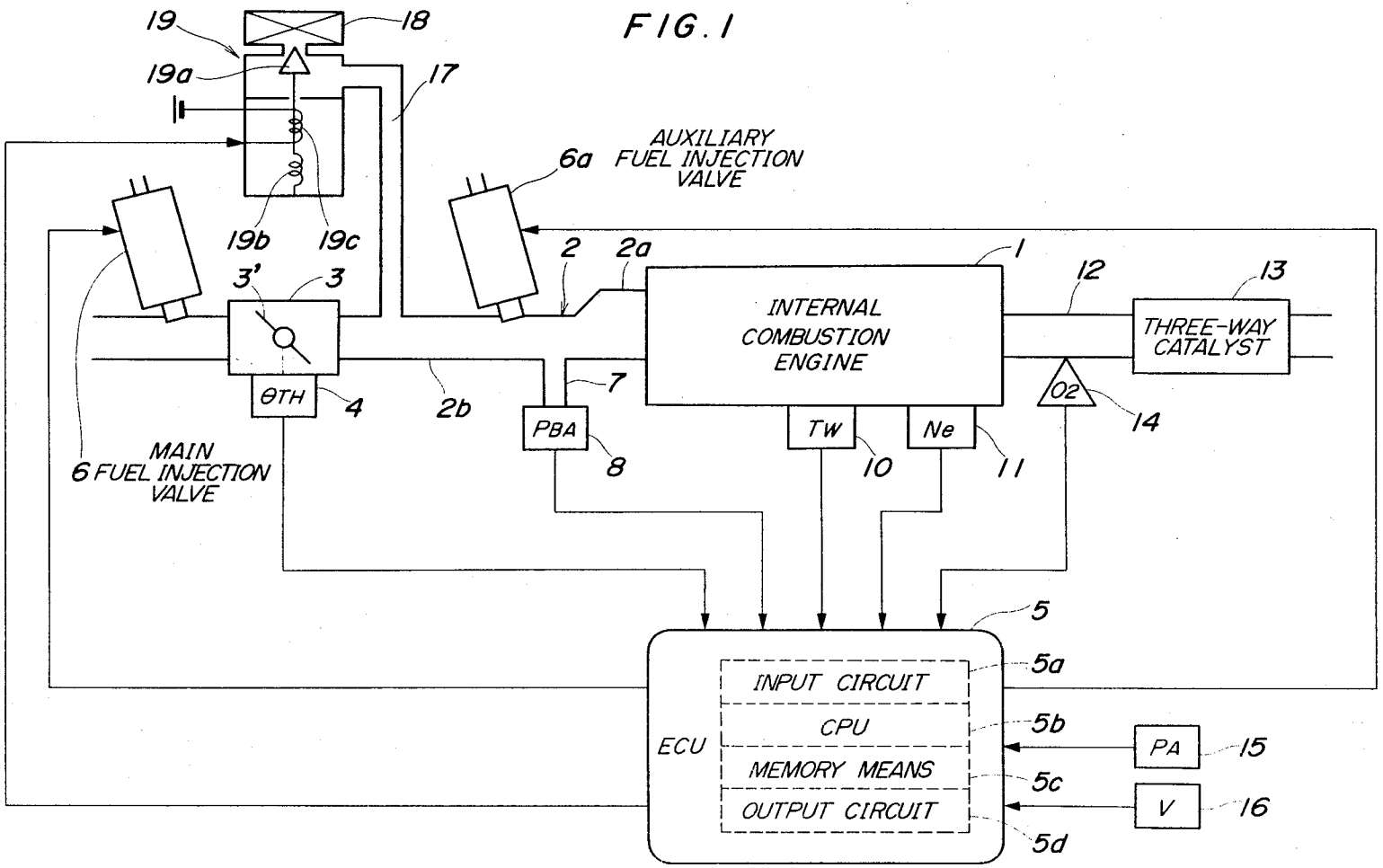
FIG. 1 is a block diagram showing the overall arrangement of a fuel supply control system for an internal combustion engine according to the present invention.

Referring first to FIG. 1, there is illustrated the whole arrangement of a fuel supply control system for an internal combustion engine, to which the method according to the invention is applied. In the figure, reference numeral 1 designates an internal combustion engine which may be a four-cylinder type, for instance. An intake pipe 2 is connected to the engine 1, which is formed by a diversified portion 2*a* having diverse pipes connected to respective cylinders and a united portion 2*b* to which the diverse pipes are joined. In the united portion 2*b* of the intake pipe 2 is arranged a throttle body 3 internally provided with a throttle valve 3'. A throttle valve opening sensor 4 (hereinafter referred to as "the $\theta_{TH}$ sensor") is connected to the throttle valve 3' to supply an electrical signal indicative of the sensed opening $\theta_{TH}$ of the throttle valve 3' to an electronic control unit (hereinafter referred to as "the ECU") 5.

A main fuel injection valve 6 is provided in the united portion 2*b* of the intake pipe 2 at a location upstream of the throttle body 3 to supply fuel to all the cylinders of the engine 1 when the engine 1 is in an operating condition other than idling. An auxiliary fuel injection valve 6*a* is provided in the united portion 2*b* of the intake pipe 2 at a location downstream of the throttle body 3 to supply fuel to all the cylinders of the engine 1 when the engine is in a warmed-up idling condition.

An air passage 17 is connected to the united portion 2*b* of the intake pipe 2 at a location between the auxiliary fuel injection valve 6*a* and the throttle body 3 and communicates the interior of the intake pipe 2 with the atmosphere. The air passage 17 has one end thereof opening to the atmosphere and having an air cleaner 18 mounted thereon. An auxiliary air control valve 19 is arranged across the air passage 17. The auxiliary air control valve 19 is a normally closed type proportional electromagnetic valve which comprises a valve body 19*a* disposed to vary the opening area of the air passage 17 in a continuous manner, a spring 19*b* urging the valve body 19*a* in a direction of closing same, and a solenoid 19*c* for moving the valve body 19*a* against the force of the spring 19*b* in a direction of opening the valve 19 when energized. The amount of current to be supplied to the auxiliary air control valve 19 is controlled by the ECU 5 such that the air passage 17 has opening areas conforming to operating conditions of the engine and load on the engine.

An absolute pressure ($P_{BA}$) sensor (hereinafter referred to as "the $P_{BA}$ sensor") 8 communicates through a conduit 7 with the interior of the intake pipe 2 at a location downstream of the auxiliary fuel injection valve 6*a*. The $P_{BA}$ sensor 8 detects absolute pressure $P_{BA}$ in the intake pipe 2 and supplies an electric signal indicative of the detected absolute pressure to the ECU 5.

An engine coolant temperature ($T_W$) sensor 10, which may be formed of a thermister or the like, is mounted in the cylinder block of the engine 1 in a manner embedded in the peripheral wall of an engine cylinder having its interior filled with coolant, detects engine coolant temperature $T_W$ and supplies an electrical signal indicative of the detected engine coolant temperature to the ECU 5. An engine rotational speed sensor (hereinafter referred to as "the Ne sensor") 11 is arranged in facing relation to a camshaft, not shown, of the engine 1 or a crankshaft of same, not shown. The Ne sensor 11 is adapted to generate a pulse of a top-dead-center position (TDC) signal (hereinafter referred to as "the TDC signal") at each of predetermined crank angles of the engine 1, i.e., at a crank angle position of each cylinder which comes a predetermined crank angle earlier relative to the top-dead-center position (TDC) at which the suction stroke thereof starts, whenever the engine crankshaft rotates through 180 degrees. The pulse generated by the Ne sensor 11 is supplied to the ECU 5.

A three-way catalyst 13 is arranged in an exhaust pipe 12 extending from the cylinder block of the engine 1 for purifying ingredients HC, CO, and NOx contained in the exhaust gases. An $0_2$ sensor 14 is inserted in the exhaust pipe 12 at a location upstream of the three-way catalyst 13 for detecting the concentration of oxygen $0_2$ in the exhaust gases and supplying an electrical signal indicative of the detected oxygen concentration to the ECU 5. Further connected to the ECU 5 are an atmospheric pressure ($P_A$) sensor 15 for detecting atmospheric pressure and a vehicle speed (V) sensor 16 for detecting the speed of a vehicle in which the engine is installed, respectively for supplying an electrical signal indicative of the detected atmospheric pressure and an electrical signal indicative of the detected vehicle speed to the ECU 5.

The ECU 5 comprises an input circuit 5*a* which shapes the respective waveforms of input signals received from some of the sensors, shift the respective voltages of signals from other sensors to a predetermined level and converts the respective analog values of the voltage-shifted input signals to corresponding digital values, a central processing unit (hereinafter referred to as "the CPU") 5*b*, a memory unit 5*c* which stores programs to be executed by the CPU 5*b* and results of operations executed by the CPU 5*b*, and an output circuit 5*d* which gives driving signals to the main fuel injection valve 6, the auxiliary fuel injection valve 6*a*, and the auxiliary air control valve 19.

According to an embodiment of the present invention, the ECU 5 constitutes deceleration detecting means, fuel supply decreasing means, high-load detecting means, first counting means for counting a first time period, inhibiting means, second counting means for counting a second time period, and intake air increasing means.

The CPU 5*b* operates in response to various engine operating parameter signals stated above, to determine operating conditions or operating regions in which the engine is operating, such as an air-fuel ratio feedback control region and an open-loop control region, based on a control program of FIG. 2, etc., hereinafter described, and then to calculate the fuel injection period $T_{OUTM}$ for which the main fuel injection valve 6 should be opened in accordance with the determined operating conditions or regions of the engine and in synchronism with generation of pulses of the TDC signal, by the use of the following equation (1).

$$T_{OUTM}=T_{iM}\times K_{WOT}\times K_{LS}\times K_1+K_2 \ldots \quad (1)$$

where TiM represents a basic value of the valve opening period for the main fuel injection valve 6, which is determined from the engine rotational speed Ne and the intake pipe absolute pressure $P_{BA}$, for example.

$K_{WOT}$ is a mixture-enriching coefficient which is set to a predetermined value larger than 1.0 when the engine 1 is in the wide-open-throttle region or high-load operating region. $K_{LS}$ is a mixture-leaning coefficient which is set to a predetermined value smaller than 1.0 when the engine 1 is in the mixture leaning region or low-load operating region.

$K_1$ and $K_2$ are other correction coefficients and correction variables, respectively, calculated on the basis of engine operating parameters by using respective predetermined arithmetic expressions, to such values as optimize operating characteristics of the engine such as startability, exhaust emission characteristics, fuel consumption and engine accelerability.

The CPU 5*b* supplies a driving signal to the main fuel injection valve 6 through the output circuit 5*d* to open same over the fuel injection period $T_{OUTM}$ calculated as above.

Figure 6:
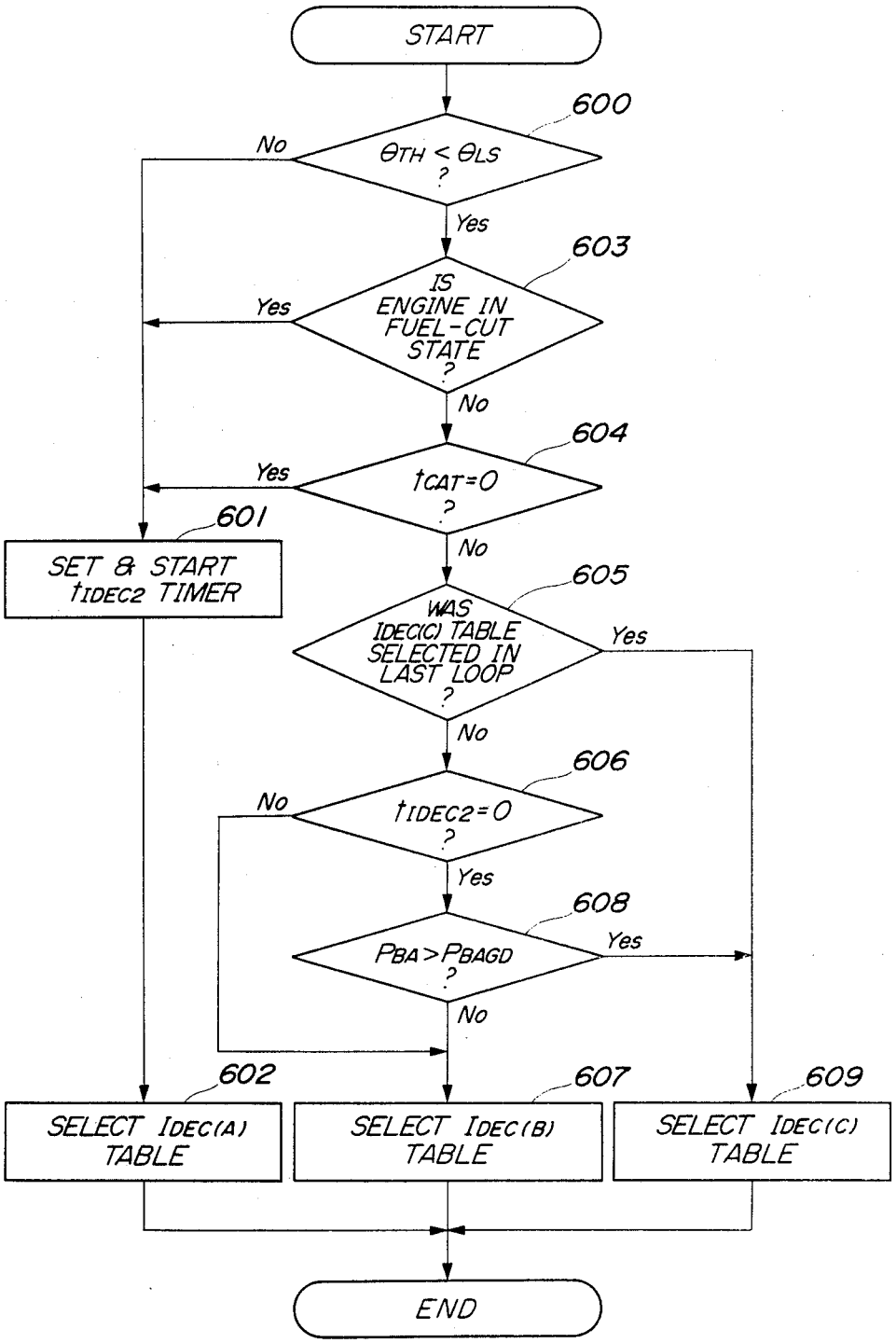
FIG. 6 is a flowchart of a subroutine for calculating an amount of electric current $I_{DEC}$ to be supplied to an auxiliary air control valve.

The CPU 5*b* operates in response to various engine operating parameter signals stated above supplied through the input circuit 5*a* whenever each pulse of the TDC signal is inputted thereto, to calculate an amount of current $I_{DEC}$ to be supplied to the solenoid 19*c* of the auxiliary air control valve 19 on the basis of a control program shown in FIG. 6 and supplies a driving signal based upon the electric supply amount $I_{DEC}$ thus calculated to the auxiliary air control valve 19 through the output circuit 5*d*.

Incidentally, the CPU 5*b* executes control of fuel supply through the auxiliary fuel injection valve 6*a* to the engine 1 when the engine 1 is idling, description thereof being omitted.

Figures 2, 2A:
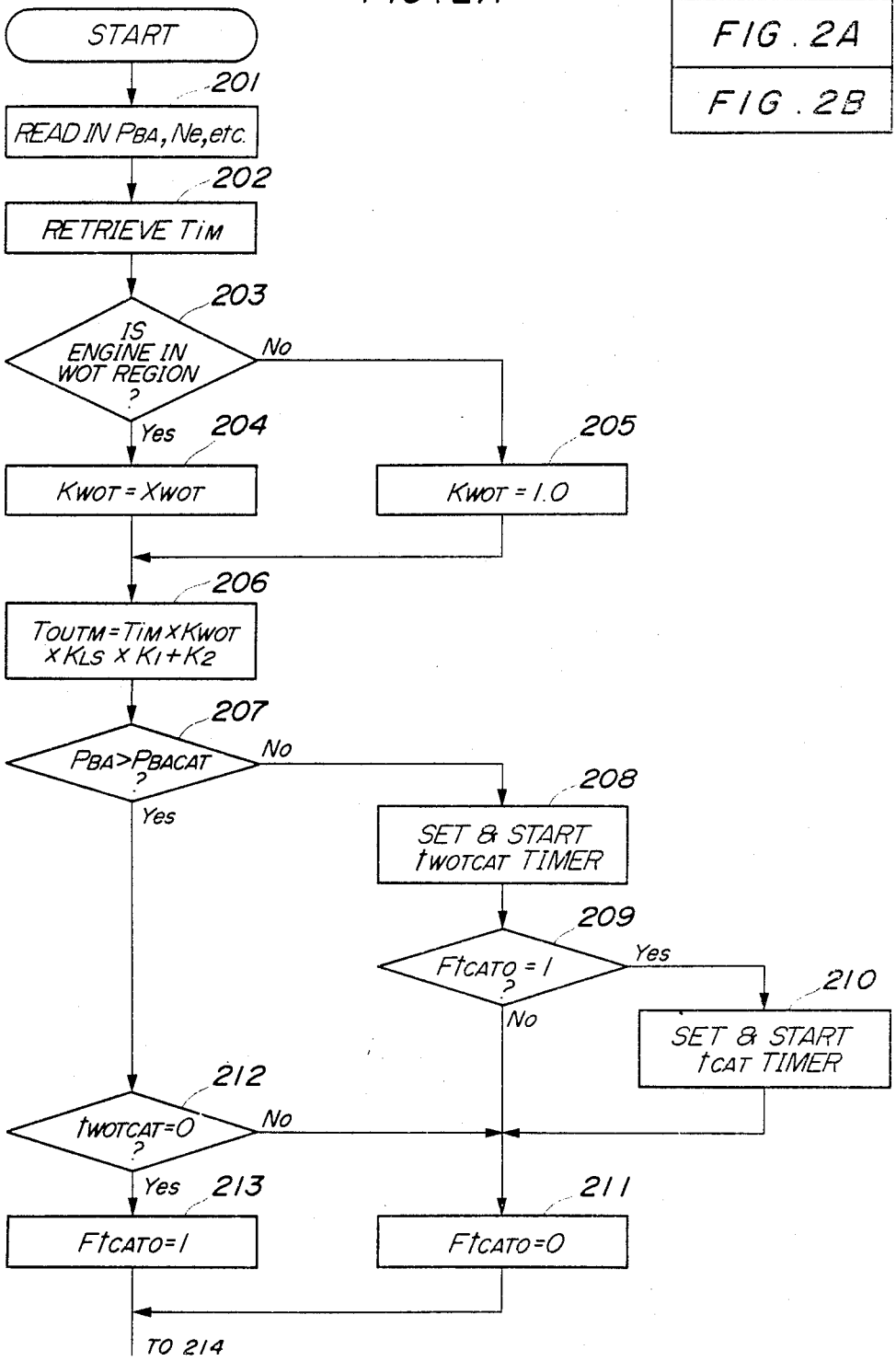
FIG. 2 is a flowchart of a control program for controlling the supply of fuel to the engine.
Figure 2B:
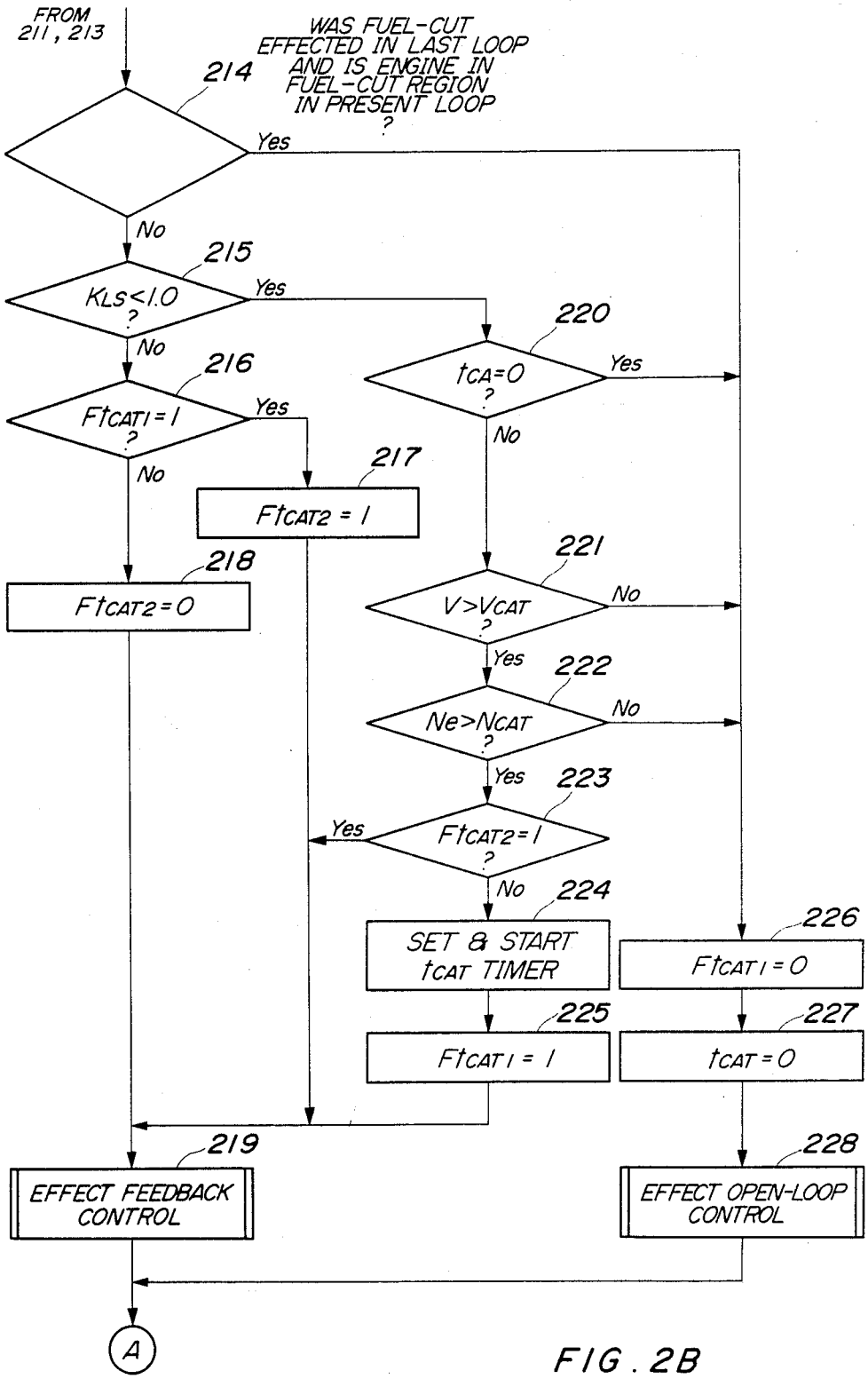
Figure 3:
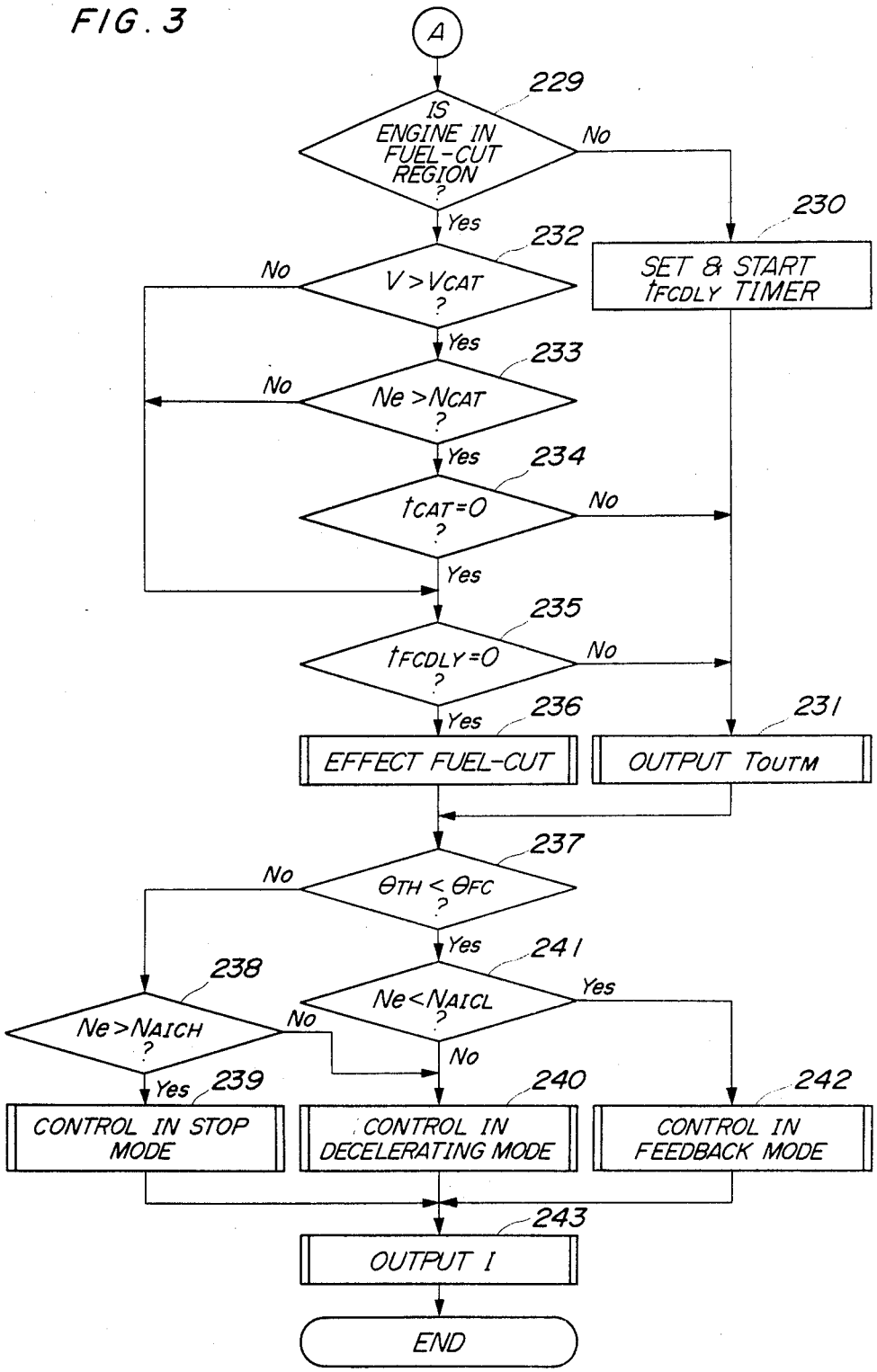
FIG. 3 is a flowchart of a control program for controlling the fuel supply, the fuel cut, and the supply of auxiliary air.

FIG. 2 and FIG. 3 show a control program for carrying out the fuel supply control according to the invention, which is executed upon generation of each pulse of the TDC signal.

First, respective values of the engine operating parameters such as the intake pipe absolute pressure $P_{BA}$ and engine rotational speed Ne are read in at a step 201, and then a basic value of the fuel injection period $T_{iM}$ for the main fuel injection valve 6 is retrieved from the $T_{iM}$ map stored in the memory means 5*c* at a step 202.

Then, at a step 203, it is determined whether or not the engine 1 is in the wide-open-throttle or WOT region by determining, for example, whether or not the fuel injection period $T_{OUTM}$ for the main injection valve 6 is larger than a predetermined time period $T_{WOT}$ (e.g., 8 milliseconds), for example. If the answer is affirmative or Yes, that is, if the engine 1 is in the wide-open-throttle region, the mixture-enriching coefficient $K_{WOT}$ is set to a value $X_{WOT}$ larger than 1.0 at a step 204. On the other hand, if the answer to the question of the step 203 is negative or No, that is, if the engine is not in the wide-open-throttle region, the mixture-enriching coefficient $K_{WOT}$ is set to 1.0 at a step 205, and the program proceeds to a step 206, hereinafter described. The value $X_{WOT}$ determined by the engine rotational speed Ne and the throttle opening degree $\theta_{TH}$, for example.

At the step 26, the fuel injection period $T_{OUTM}$ for which the main fuel injection valve 6 should be opened is calculated in accordance with the basic fuel injection period $T_{iM}$ read at the step 202, mixture-enriching coefficient $K_{WOT}$ set at the step 204 or 205, other correction coefficients and correction variables $K_{LS}$, $K_1$, and $K_2$, respectively, determined on the basis of engine operating parameters read into the CPU 5*b*, by the use of the equation (1).

Then, it is determined at a step 207 whether or not the intake pipe absolute pressure $P_{BA}$ is higher than a predetermined value $P_{BACAT}$. This step is for determining whether or not the engine 1 is in a high-load operating condition in which fuel is apt to adhere to the inner wall of the intake pipe, etc.

Figure 4:
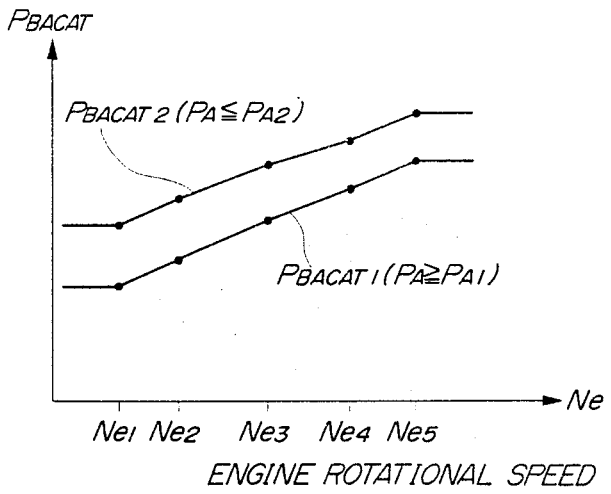
FIG. 4 is a graph showing tables of the relationship between a predetermined absolute pressure value $P_{BA\text{-}CAT}$, engine rotational speed Ne, and atmospheric pressure $P_A$, which is applied to the determination of a step 207 in FIG. 2.

FIG. 4 shows a $P_{BACAT}$ table for setting the predetermined value $P_{BACAT}$ based upon the engine rotational speed Ne and the atmospheric pressure $P_A$. To be specific, the predetermined value $P_{BACAT}$ is set such that the higher the engine rotational speed Ne the larger the $P_{BACAT}$ value. Five $P_{BACAT1}$ values are provided at five predetermined engine rotational speed values Ne1–Ne5 and applied when the atmospheric pressure is equal to or higher than a first predetermined atmospheric pressure value $P_{A1}$ (e.g., 800 mmHg), and five $P_{BACAT2}$ values, which are larger than the respective corresponding $P_{BACAT1}$ values, are also set at the five predetermined engine rotational speed values Ne1–Ne5 and applied when the atmospheric pressure is equal to or lower than a second predetermined value $PA_2$ (e.g., 650 mmHg) which is lower than the first predetermined value $P_{A1}$. When the actual engine rotational speed lies between adjacent ones of the five values Ne1–Ne5, the predetermined value $P_{BACAT}$ is determined by an interpolation method using the actual engine rotational speed. Also, when the atmospheric pressure $P_A$ lies between the first and second predetermined values $P_{A1}$ and $P_{A2}$, the predetermined value $P_{BACAT}$ is determined by an interpolation method using the actual atmospheric pressure $P_A$.

The reason for setting the predetermined value $P_{BACAT}$ such that the higher the engine rotational speed Ne the larger the value $P_{BACAT}$ is that the higher the engine rotational speed Ne the higher the flow speed of intake air and accordingly the smaller amount of fuel adheres to the inner wall of the intake pipe, etc. On the other hand, the reason for setting the predetermined value $P_{BACAT}$ such that the lower the atmospheric pressure $P_A$, i.e., the higher the altitude at which the vehicle is running, the larger the value $P_{BACAT}$ is that at a high altitude the weight or density of intake air is smaller than at a low altitude so that excessive rise of the temperature of the three-way catalyst can take place at higher load operation of the engine 1.

Figure 5:
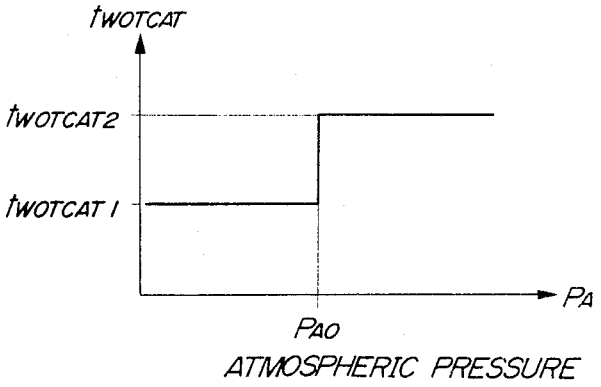
FIG. 5 is a graph showing tables of the relationship between a second predetermined time period $t_{WOTCAT}$ and atmospheric pressure $P_A$.

Referring again to FIG. 2, if the answer to the question of the step 207 is negative or No, that is, if $P_{BA} \leqq P_{BACAT}$ is satisfied, a $t_{TWOTCAT}$ timer formed by a down counter is started to count a second predetermined time period value $t_{TWOTCA}T$ at a step 208, and the program proceeds to a step 209, hereinafter described. The $t_{WOTCAT}$ timer is provided to determine whether or not the intake pipe absolute pressure $P_{BA}$ has continually been higher than the predetermined value $P_{BACAT}$ over a second predetermined time period $t_{WOTCAT}$. FIG. 5 shows one example of a table for setting the second predetermined time period $t_{WOTCAT}$ wherein the second predetermined time period $t_{WOTCAT}$ is set depending upon the atmospheric pressure $P_A$. Specifically, the time period $t_{WOTCAT}$ is set to a first predetermined value $t_{WOTCAT1}$ (e.g., 10 seconds) when the atmospheric pressure $P_A$ is lower than a reference value $P_{A0}$, while it is set to a second predetermined value $t_{WOTCAT2}$ (e.g., 16 seconds), which is higher than the first predetermined value $t_{WOTCAT1}$, when the atmospheric pressure $P_A$ is equal to or higher than the reference value $P_{A0}$.

At the aforementioned step 209, it is determined whether or not a first flag $F_{tCAT0}$, which value is initially set to 0, is equal to 1. If the answer is affirmative or Yes, a $t_{CAT}$ timer formed by a down counter, hereinbelow described, is set to a first predetermined time period $t_{CAT}$ (e.g., 10 seconds) and started to count same at a step 210. If the answer is negative or No, the program proceeds to a step 211, wherein the first flag $F_{tCAT0}$ is set to 0, followed by executing a step 214, hereinafter described.

On the other hand, if the answer to the question of the step 207 is affirmative or Yes, that is, if $P_{BA} > P_{BACAT}$ is satisfied, it is determined whether or not the counted value $t_{WOTCAT}$ of the $t_{WOTCAT}$ timer is equal to 0 at a step 212. If the answer is negative or No, the step 211 is executed, whereas if the answer is affirmative or Yes, the first flag $F_{tCAT0}$ is set to 1 at a step 213, and the program proceeds to a step 214, hereinafter described.

As described above, the $t_{CAT}$ timer is set and started when $P_{BA} \leqq P_{BACAT}$ and $F_{tCAT0}=0$ are satisfied at the same time, wherein the first flag $F_{tCAT0}$ has a value 1 only when the state of $P_{BA} > P_{BACAT}$ continued over the second predetermined time period $t_{WOTCAT}$. To be specific, the $t_{CAT}$ timer serves to descriminate whether or not the first predetermined time period $t_{CAT}$ has elapsed after the state $P_{BA} > P_{BACAT}$ continued over the second predetermined time period $t_{WOTCAT}$ and then the engine 1 left the former state, that is, whether or not a large amount of fuel adheres to the inner wall of the intake pipe, etc.

At the steps 214 through 228, it is determined whether control of air-fuel ratio is to be executed under feedback control or open-loop control.

At the step 214, it is determined whether or not interruption of fuel supply (hereinafter referred to as "the fuel-cut") was effected in the last loop, and the engine 1 is being in a fuel-cut region in the present loop, i.e., whether or not the engine 1 is in a deccelerating state. This step is executed by determining whether or not the opening $\theta_{TH}$ of the throttle valve 3' is substantially closed when the engine rotational speed Ne is lower than a predetermined value $N_{FC}$, or by determining whether or not the intake pipe absolute pressure $P_{BA}$ is lower than a predetermined value $P_{BAFC}$, which is set to a value increasing with increase of the engine rotational speed Ne, when the engine rotational speed Ne is equal to or higher than the predetermined value $N_{FC}$.

If the answer to the question of the step 214 is negative or No, it is determined at a step 215 whether or not the mixture-leaning coefficient $K_{LS}$ is smaller than 1.0, that is, whether or not the engine 1 is in the mixture leaning region including the fuel-cut region. If the answer is negative or No, that is, if the engine 1 is not in the mixture leaning region and accordingly it is in the feedback control region, it is determined whether a second flag $F_{tCAT1}$ (which value is initially set to 1) is equal to 1 or not at a step 216. If the answer is affirmative or Yes, a third flag $F_{tCAT2}$ is set to 1 at a step 217, whereas if the answer is negative or No, the third flag $F_{tCAT2}$ is set to 0 at a step 218, and then the program proceeds to a step 219.

At the step 219, the fuel injection period $T_{OUTM}$ is calculated for effecting feedback control of the air-fuel ratio in response to the output of the $O_2$ sensor 14 so as to bring the air-fuel ratio of the mixture supplied to the engine 1 to a stoichiometric value.

If the answer to the question of the step 215 is affirmative or Yes, that is, if $K_{LS} < 1.0$ is satisfied and accordingly the engine 1 is in the mixture leaning region, it is determined at a step 220 whether or not the counted value $t_{CAT}$ of the aforementioned timer $t_{CAT}$ is equal to 0. If the answer is negative or No, that is, if the counted value $t_{CAT}$ is not equal to 0, which means that $P_{BA} > P_{BACAT}$ continued over the second predetermined time period $t_{WOTCAT}$ but the first predetermined time period $t_{CAT}$ has not yet elapsed after the engine 1 left the high-load operating region, it is determined at a step 221 whether or not the speed V of the vehicle in which the engine is installed is higher than a predetermined value $V_{CAT}$ (e.g., 10 km/h), and then at a step 222 whether or not the engine rotational speed Ne is higher than a predetermined value $N_{CAT}$ (e.g., 2,600 rpm). The above steps 211 and 212 are for discriminating whether or not the three-way catalyst 13 is in a hot state, in which there is the possibility of occurrence of after-fire. If the answers to the questions of the steps 221 and 222 are both affirmative or Yes, that is, if $V > V_{CAT}$ and $Ne > N_{CAT}$ are satisfied at the same time, it is assumed that the three-way catalyst 13 is hot, and then it is determined at a step 223 whether the third flag $F_{tCAT2}$ is equal to 1 or not. If the answer to the question of the step 223 is negative or No, the $t_{CAT}$ timer is reset to the first predetermined time period $t_{CAT}$ and started again at a step 224, then at a step 225 the second flag $F_{tCAT1}$ is set to 1, and thereafter the aforementioned step 219 is executed to effect feedback control of the air-fuel ratio.

As described above, according to the invention, when the state of $P_{BA} > P_{BACAT}$ continued over the second predetermined time period $t_{WOTCAT}$, and the engine 1 leaves the high-load operating region and shifts to the mixture leaning region before the lapse of the first predetermined time period $t_{CAT}$, the feedback control of the air-fuel ratio is effected in response to the output of the $O_2$ sensor 14 even in the mixture leaning region in which conventionally the open-loop control is to be effected. This feedback control maintains the air-fuel ratio of the mixture at a stoichiometric value and thereby positively prevents overriching of the mixture supplied to the engine 1, which was conventionally caused by suction of the fuel adhering to the intake pipe inner wall, etc. into the combustion chambers.

When the engine 1 shifts from the high-load operating region to the mixture leaning region through the feedback control region, the third flag $F_{tCAT2}$ has been set to 0 so that the answer to the question of the step 223 becomes negative or No, and accordingly the $t_{CAT}$ timer is repeatedly set and started at the step 224. Therefore, as long as the engine 1 stays in the mixture leaning region, the answer to the question of the step 220 continues to be negative or No, thereby repeatedly effecting the feedback control provided that the answers to the questions of the steps 221 and 222 are affirmative or Yes.

Further, in the case where the engine 1 once shifts from the mixture leaning region in which feedback control is effected to the feedback control region and soon again returns to the mixture leaning region, e.g., when the accelerator pedal is depressed for a brief time period in the mixture leaning region, the second flag $F_{tCAT1}$ is set to 1 at the step 225 in the mixture leaning region, and the third flag $F_{tCAT2}$ is set to 1 by executing the steps 216 and 217 in the feedback control region so that when the engine 1 returns to the mixture leaning region, the answer to the question of the step 223 is affirmative or Yes and accordingly the step 224 is not executed. Consequently, the feedback control is uninterruptedly continued after the engine 1 first shifts from the mixture leaning region and until the lapse of the first predetermined time period $t_{CAT}$ of the $t_{CAT}$ timer which has been started in the first mixture leaning region, thereby preventing emission of unburnt fuel as well as overriching of the mixture.

On the other hand, if the answer to the question of the step 220 is affirmative or Yes, that is, if $t_{CAT}=0$ is satisfied, specifically, if the high-load operating condition, i.e., $P_{BA} > P_{BACAT}$, did not continue over the second predetermined time period $t_{WOTCAT}$ or if the above high-load operating condition continued over the second predetermined time period $t_{WOTCAT}$ and thereafter the first predetermined time period $t_{CAT}$ has elapsed after the engine 1 left the high-load operating region, it is assumed that a large amount of fuel no longer remains on the inner wall of the air intake pipe, etc. Consequently, the second flag $F_{tCAT1}$ is set to 0 at a step 226, the counted value of the $t_{CAT}$ timer is set to 0 at a step 227, and then the program proceeds to a step 228, wherein open-loop control is effected, followed by executing a step 229, hereinafter described.

If one of the answers to the questions of the steps 221 and 222 is negative or No, that is, if either $V \leqq V_{CAT}$ or $Ne \leqq N_{CAT}$ is satisfied, it is assumed that the three-way catalyst 13 is not in a hot state and hence there is almost no possibility of after-fire. Therefore, open-loop control is effected for leaning the mixture by executing the steps 226 through 228.

Further, if the answer to the question of the step 214 is affirmative or Yes, that is, if fuel-cut was effected in the last loop and the engine 1 is being in the fuel-cut region in the present loop, the steps 226 through 228 are also executed. Thus, the counted value of the $t_{CAT}$ timer is set to 0 only when the fuel-cut was effected in the last loop and the engine 1 stays in the fuel-cut region in the present loop, so that when the engine 1 shifts from the mixture leaning region, in which the feedback control of the air-fuel ratio is effected, to the fuel-cut region and immediately returns to the mixture leaning region, the counted value of the $t_{CAT}$ timer is not equal to 0, and hence the answer to the question of the step 220 becomes negative or No, thereby continuously effecting the feedback control.

The steps 229 through 236 are for executing the fuel-cut and terminating same.

First, it is determined at the step 229 whether or not the engine 1 is in the fuel-cut region. If the answer is negative or No, that is, if the engine 1 is not in the fuel-cut region, a $t_{FCDLY}$ timer formed by a down counter is set to a predetermined time period $t_{FCDLY}$ and start the same, and then a driving signal indicative of the fuel injection period calculated at the step 219 or 228 is inputted to the main fuel injection valve 6 to drive same for effecting fuel injection at a step 231, and the program proceeds to a step 237, hereinafter described.

If the answer to the question of the step 229 is affirmative or Yes, that is, if the engine 1 is in the fuel-cut region, steps 232 and 233 are executed in just the same manner as the above steps 221 and 222. If both answers to the question of the steps 232 and 233 are affirmative or Yes, that is, if $V > V_{CAT}$ and $Ne > N_{CAT}$ are satisfied at the same time, it is determined at a step 234 whether or not the counted value of the $t_{CAT}$ timer is equal to 0 similarly to the step 220. If the answer is negative or No, the step 231 is executed.

Figure 9:
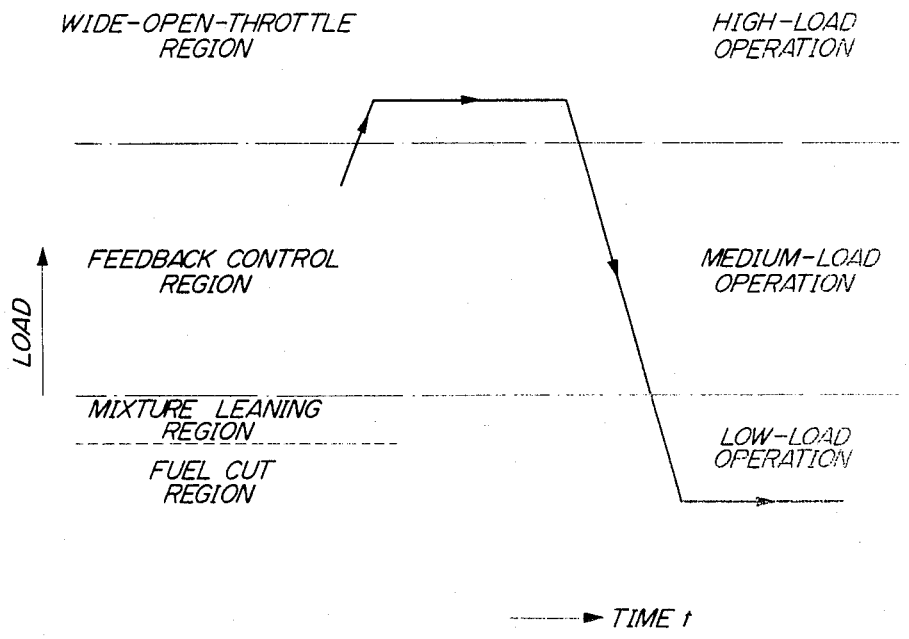
FIG. 9 is a diagram showing the relationship between different engine-load operating conditions of the engine and air-fuel ratio control regions, applied at transition of the engine from a high load operating condition to a low load one.

Thus, even when the engine 1 is in the fuel-cut region, the fuel-cut is not effected when it is assumed that the three-way catalyst 13 is in a hot state and that a large amount of fuel adheres to the inner wall of the intake pipe, etc. In this case, even if the fuel-cut is not effected, the mixture leaning control is effected by the use of the mixture leaning coefficient $K_{LS}$, because the fuel-cut region is included within the mixture leaning region, as shown in FIG. 9. In the mixture leaning control, a large amount of auxiliary air is supplied to the engine 1 so that unburnt mixture emitted from the engine 1 is reduced, thereby preventing occurrence of after-fire, as described later.

If the answer to the question of the step 234 is affirmative or Yes, that is, if $t_{CAT}=0$ is satisfied or if one of the answers to the questions of the steps 232 and 233 is negative or No, i.e., $V \leqq V_{CAT}$ or $Ne \leqq N_{CAT}$ is satisfied, it is determined whether the counted value $t_{FCDLY}$ of the $t_{FCDLY}$ timer which has been started at the step 230 is equal to 0 or not at a step 235. If the answer is negative or No, the step 231 is executed instead of executing the fuel-cut, whereas if the answer is affirmative or Yes, the fuel-cut is executed at a step 236.

The reason for providing a given waiting time period ($=t_{FCDLY}$) for executing the fuel-cut is that when a condition for executing the fuel-cut is instantaneously satisfied, fuel-cut is continuously interrupted in order to stabilize the control of the air-fuel ratio.

The following steps 237 through 243 are for executing control of the auxiliary air control valve 19.

First, it is determined at the step 237 whether or not the opening $\theta_{TH}$ of the throttle valve 3' is smaller than a predetermined value $\theta_{FC}$. If the answer is negative or No, it is determined whether or not the engine rotational speed Ne is higher than a high engine speed-descriminating value $N_{AICH}$ (e.g., 4,000 rpm) at the step 238. If the answer of the question of the step 237 is affirmative or Yes, that is, if $\theta_{TH} \leqq \theta_{FC}$ and $Ne > N_{AICH}$ are satisfied at the same time, and accordingly the engine 1 is in a high-speed operating state, the auxiliary air control valve 19 is controlled in a stop mode, i.e., rendered inoperative, at the step 239, and the program proceeds to the step 243, hereinafter described. During this control, the amount of intake air passing through the throttle body 3 is so large that no auxiliary air is supplied to the engine 1 by making zero the amount of electric current I supplied to the auxiliary air control valve 19.

If the answer to the question of the step 238 is negative or No, that is, if $\theta_{TH} \leqq \theta_{FC}$ and $Ne \leqq N_{AICH}$ are satisfied at the same time, the amount of current I to be supplied to the auxiliary air control valve 19 is determined in a decelerating mode at the step 240, followed by executing the step 243.

If the answer to the question of the step 237 is affirmative or Yes, that is, if $0_{TH} > 0_{FC}$ is satisfied, it is determined at the step 241 whether or not the engine rotational speed Ne is higher than a low engine speed-descriminating value $N_{AICL}$ (e.g., 800 rpm). If the answer is negative or No, that is, if $Ne \leqq N_{AICL}$ is satisfied, the step 240 is executed, whereas if the answer is affirmative or Yes, that is, if $Ne < N_{AICL}$ is satisfied, the amount of electric current I to be supplied to the auxiliary air control valve 19 is determined in a feedback mode, wherein the current amount I is controlled in a feedback mammer so as to bring the idling speed to a desired value at the step 242, followed by executing the step 243.

Then, at the step 243, the electric current I which has been determined in each of the control modes described above is inputted to the auxiliary air control valve 19, followed by terminating the present program.

FIG. 6 shows a subroutine for calculating the amount of electric current I to be supplied to the auxiliary air control valve 19, which is executed in the decelerating mode.

First, it is determined at a step 600 whether or not the throttle opening $\theta_{TH}$ is smaller than a mixture leaning-discriminating value $\theta_{LS}$. If the answer is negative or No, or if $\theta_{TH} \geqq \theta_{LS}$ is satisfied and hence the engine 1 is in the feedback control region or in the $W_{TO}$ region, not in the mixture leaning region, a $t_{IDEC2}$ timer formed by a down counter is started to count a predetermined time period $t_{IDEC2}$, e.g., 2 seconds, at a step 601, and then an $I_{DEC}(A)$ table is selected from among $I_{DEC}$ tables at a step 602 to thereby calculate the amount of current $I_{DEC}$, then terminating the program.

Figure 7:
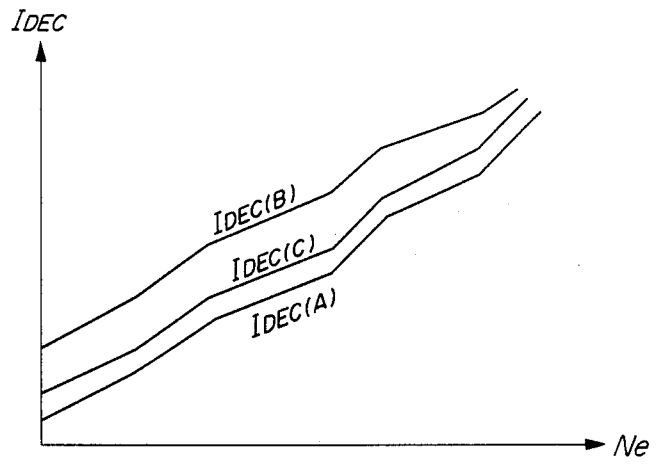
FIG. 7 is a graph showing $I_{DEC}$ tables to be selected by the subroutine of FIG. 6.

FIG. 7 shows an example of the $I_{DEC}$ tables, wherein three tables are provided, i.e., $I_{DEC(A)}$, $I_{DEC(B)}$, and $I_{DEC(C)}$. In each table, the amount of current $I_{DEC}$ is set such that it increases with increase of the engine rotational speed Ne. The relationship between the tables is $I_{DEC(A)} < I_{DEC(B)} < I_{DEC(C)}$ at the same engine rotational speed Ne.

Therefore, when the engine 1 is in the feedback control region or in the $W_{OT}$ region, the steps 600 and 602 are executed to set the amount of current $I_{DEC}$ to the smallest value, e.g., a value based on the table $I_{DEC(A)}$ of FIG. 6, thus supplying the smallest amount of auxiliary air to the engine 1.

On the other hand, if the answer to the question of the step 600 is affirmative or Yes, that is, if $\theta_{TH} < \theta_{LS}$ is satisfied and hence the engine 1 is in the mixture leaning region, it is determined whether the engine 1 is in a fuel-cut state or not at a step 603. If the answer is affirmative or Yes, the steps 601 and 602 are executed for supplying the engine 1 with the smallest amount of the auxiliary air.

If the answer to the question of the step 603 is negative or No, that is, if the engine 1 is not in the fuel-cut state, it is determined at a step 604 whether the counted value $t_{CAT}$ of the $t_{CAT}$ timer is equal to 0 or not. If the answer is affirmative or Yes, that is, if $t_{CAT}=0$ is satisfied, it is assumed that the amount of fuel adhering to the inner wall of the intake pipe, etc. is not so large and then the steps 601 and 602 are executed to supply the smallest amount of auxiliary air to the engine 1.

If the answer to the question of the step 604 is negative or No, that is, if the counted value $t_{CAT}$ is not equal to 0 and hence the feedback control is being effected by the control program of FIGS. 2 and 3, it is determined at a step 605 whether or not the table $I_{DEC(C)}$ was selected from among the $I_{DEC}$ tables in the last loop. If the answer is negative or No, it is determined whether or not the counted value $t_{IDEC2}$ of the $t_{IDEC2}$ timer, which has been started at the step 601, is equal to 0, at a step 606. This determination is for discriminating whether the absolute pressure within the intake pipe $P_{BA}$, which is compared at a step 608, hereinafter described, is in a stable state or not. If the answer is negative or No, that is, if the counted value $t_{IDEC2}$ is not equal to 0, the table $I_{DEC(B)}$ is selected at a step 607 and the amount of electric current $I_{DEC}$ is calculated based upon the selected table $I_{DEC(B)}$, followed by terminating the program.

Figure 8:
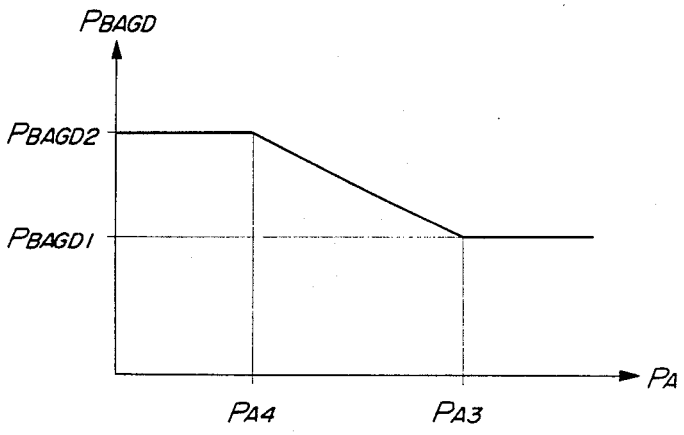
FIG. 8 is a graph showing a table of the relationship between a predetermined value $P_{BAGD}$ and atmospheric pressure $P_A$, which is applied to the subroutine of FIG. 6.

If the answer to the question of the step 606 is affirmative or Yes, that is, if $t_{IDEC2}=0$ is satisfied, it is determined at the step 608 whether the intake pipe absolute pressure $P_{BA}$ is higher than a predetermined value $P_{BAGD}$ or not. The predetermined value $P_{BAGD}$ represents intake pipe absolute pressure assumed with no load on the engine 1, which may be set based upon a $P_{BAGD}$ table shown in FIG. 8, for example, depending upon the atmospheric pressure $P_A$. Specifically, the predetermined value $P_{BAGD}$ is set to a first predetermined value $P_{BAGD1}$ (e.g., 161 mmHg) when the atmospheric pressure is higher than a first predetermined value $P_{A3}$, while it is set to a second predetermined value $P_{BAGD2}$ (e.g., 191 mmHg), which is higher than the first predetermined value $P_{BAGD1}$, when the atmospheric pressure is lower than a second predetermined value $P_{A4}$. When the atmospheric pressure falls between the first and second predetermined values $P_{A3}$ and $P_{A4}$, the value $P_{BAGD}$ is determined by an interpolation method.

Referring again to FIG. 6, if the answer to the question of the step 608 is negative or No, that is, if $P_{BA} \leqq P_{BAGD}$ is satisfied, the step 607 is executed to select the table $I_{DEC(B)}$ for supplying a large amount of auxiliary air to the engine 1, whereas if the answer is affirmative or Yes, that is, if $P_{BA} > P_{BAGD}$ is satisfied, the table $I_{DEC(C)}$ is selected at a step 609, thereby supplying a medium amount of auxiliary air to the engine 1.

In this way, when the engine 1 is in the mixture leaning region, a large amount of auxiliary air is supplied to the engine 1 to thereby cause fuel adhering to the engine intake pipe, etc. to be carried by air into the engine combustion chambers for enhancing combustion therein. Further, even if the absolute pressure $P_{BA}$ within the engine intake pipe is increased by the supply of auxiliary air, it is maintained at or below a value of intake pipe absolute pressure assumed with no load on the engine 1, so as to lower the engine rotational speed Ne for securing a desired deccelerating state of the engine 1.

If the answer to the question of the step 605 is affirmative or Yes, that is, if the table $I_{DEC(C)}$ was selected in the last loop, the step 609 is executed to thereby select the same table. Thus, once the table $I_{DEC(C)}$ been selected, it is continually selected thereafter, thus positively preventing the intake pipe absolute pressure $P_{BA}$ from increasing, i.e., varying toward higher load on the engine 1.

What is claimed is:

1. A fuel supply control system for an internal combustion engine having a plurality of cylinders, and an intake pipe connected to said cylinders and having a diversified portion and a united portion, said fuel supply control system including at least one fuel injection valve arranged in said united portion of said intake pipe, for supplying fuel to said cylinders, deceleration detecting means for detecting a predetermined decelerating condition of said engine, and fuel supply decreasing means for decreasing the supply of fuel to said engine through said fuel injection valve when said predetermined decelerating condition is detected by said deceleration detecting means, the improvement comprising:

(1) high-load detecting means for detecting whether said engine is in a predetermined high-load condition or not;

(2) first counting means associated with said high-load detecting means, for starting to count a first predetermined time period when said high-load detecting means detects that said engine has left said predetermined high-load condition; and (3) inhibiting means associated with said first counting means and said deceleration detecting means, for inhibiting said fuel supply decreasing means from operating when said deceleration detecting means detects said predetermined decelerating condition of said engine before said first counting means completes counting said first predetermined time period.

2. A fuel supply control system as claimed in claim 1, wherein said predetermined decelerating condition comprises a mixture leaning condition, and a fuel-cut condition, said fuel supply decreasing means being operable insofar as said inhibiting means is inoperative to decrease the amount of fuel supplied to said engine when said engine is in said mixture leaning condition, and to interrupt the supply of fuel to said engine when said engine is in said fuel-cut condition.

3. A fuel supply control system as claimed in claim 1, including second counting means associated with said high-load detecting means, for counting a second predetermined time period while said high-load detecting means is detecting said predetermined high-load condition of said engine, said first counting means being associated with said second counting means, for starting to count said first predetermined time period when said second counting means has completed counting said second predetermined time period.

4. A fuel supply control system as claimed in any of claims 1 to 3, wherein said inhibiting means continues to inhibit the operation of said fuel supply decreasing means until said first counting means completes counting said first predetermined time period.

5. A fuel supply control system as claimed in any of claims 1 to 3, including intake air increasing means associated with said inhibiting means, for increasing the amount of intake air supplied to said engine while said inhibiting means is operating.

6. A fuel supply control system as claimed in claim 5, wherein the amount by which the intake air is to be increased is determined such that absolute pressure within said intake pipe is maintained below a value assumed with no load on said engine.

7. A fuel supply control system as claimed in claim 1, wherein said engine is installed in a vehicle, said system further including vehicle speed sensing means for sensing the speed of said vehicle, said inhibiting means being associated with said vehicle speed sensing means, for inhibiting the operation of said fuel supply decreasing means when the sensed vehicle speed is higher than a predetermined value.

8. A fuel supply control system as claimed in claim 1 or claim 7, including engine speed sensing means for sensing the rotational speed of said engine, said inhibiting means being associated with said engine speed sensing means, for inhibiting the operation of said fuel supply decreasing means when the sensed engine rotational speed is higher than a predetermined value.

9. A fuel supply control system as claimed in claim 1, including absolute pressure sensing means for sensing absolute pressure within said intake pipe, said high-load detecting means being associated with said absolute pressure sensing means, for determining that said engine is in said predetermined high-load condition when the sensed absolute pressure is higher than a predetermined value.

10. A fuel supply control system as claimed in claim 9, including engine speed sensing means for sensing the rotational speed of said engine, and wherein said predetermined value of absolute pressure is determined by the sensed engine rotational speed.

11. A fuel supply control system as claimed in claim 9 or claim 10, including atmospheric pressure sensing means for sensing atmospheric pressure, and wherein said predetermined value of absolute pressure is determined by the sensed atmospheric pressure.

12. A fuel supply control system as claimed in claim 3, including atmospheric pressure sensing means for sensing atmospheric pressure, and wherein said second predetermined time period is determined by the sensed atmospheric pressure.

13. A fuel supply control system as claimed in claim 2, including second counting means associated with said high-load detecting means, for counting a second predetermined time period while said high-load detecting means is detecting said predetermined high-load condition of said engine, said first counting means being associated with said second counting means, for starting to count said first predetermined time period when said second counting means has completed counting said second predetermined time period.

* * * * *